US009874212B2

(12) United States Patent
Theelen et al.

(10) Patent No.: US 9,874,212 B2
(45) Date of Patent: Jan. 23, 2018

(54) HOUSING FOR A FAN OF A SCROLL COMPRESSOR

(71) Applicant: ATLAS COPCO AIRPOWER, NAAMLOZE VENNOOTSCHAP, Wilrijk (BE)

(72) Inventors: Jochen Emiel C. Theelen, Wilrijk (BE); Gert August Van Leuven, Wilrijk (BE); Luc Van Mieghem, Wilrijk (BE); Wim Jan L. Mathys, Wilrijk (BE); Tom Andre J. Potters, Wilrijk (BE); Koen Stoop, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 217 days.

(21) Appl. No.: 14/780,263

(22) PCT Filed: Mar. 25, 2014

(86) PCT No.: PCT/BE2014/000014

§ 371 (c)(1),
(2) Date: Sep. 25, 2015

(87) PCT Pub. No.: WO2014/161050

PCT Pub. Date: Oct. 9, 2014

(65) Prior Publication Data

US 2016/0053760 A1 Feb. 25, 2016

(30) Foreign Application Priority Data

Apr. 5, 2013 (BE) ..... 2013/0240

(51) Int. Cl.
*F04C 18/02* (2006.01)
*F04D 29/42* (2006.01)
(Continued)

(52) U.S. Cl.
CPC ..... *F04C 18/0223* (2013.01); *F04C 29/04* (2013.01); *F04D 29/424* (2013.01); *F04D 29/4253* (2013.01); *F04D 29/582* (2013.01)

(58) Field of Classification Search
CPC ..... F04C 29/04; F04D 29/424; F04D 29/4253
See application file for complete search history.

(56) References Cited

U.S. PATENT DOCUMENTS 2,770,496 A 11/1956 Wilson
6,190,145 B1 2/2001 Fujioka et al.
(Continued)

FOREIGN PATENT DOCUMENTS

DE 102009050684 A1 4/2011
EP 2224136 A2 9/2010
(Continued)

OTHER PUBLICATIONS

International Search Report (ISR) dated Sep. 11, 2014, for PCT/BE2014/000014.

*Primary Examiner* — Mary A Davis
(74) *Attorney, Agent, or Firm* — Bacon & Thomas, PLLC

(57) ABSTRACT

Housing for channelling the airflow of a radial fan of an air-cooled scroll compressor, where this housing is formed by a volute with an outlet and an outlet bend connecting thereto with an included angle. The included angle is an acute angle that extends from one side of the median plane defined by the axis of the inlet and the center of the output of the outlet bend to the other side of the median plane located on the side of the end point of the transverse wall and up to a distance from this median plane.

21 Claims, 9 Drawing Sheets

(51) Int. Cl.
*F04C 29/04* (2006.01)
*F04D 29/58* (2006.01)

(56) References Cited

U.S. PATENT DOCUMENTS 6,530,346 B1 * 3/2003 Coones ..... F04D 29/4253
122/4 R
8,979,515 B2 3/2015 Iwano et al.

FOREIGN PATENT DOCUMENTS

| | | | |
|---|---|---|---|
| JP | S60-182399 | A | 9/1985 |
| JP | S61-149798 | U1 | 9/1986 |
| JP | 2000-120568 | A | 4/2000 |
| JP | 2012-255409 | A | 12/2012 |

* cited by examiner

PRIOR ART

PRIOR ART

HOUSING FOR A FAN OF A SCROLL COMPRESSOR

The present invention relates to a housing for a fan of a scroll compressor.

BACKGROUND OF THE INVENTION

A scroll compressor is used to compress air or another gas through the interaction of two spiral-shaped windings that are each affixed on a plate, whereby these windings mesh together and are moved eccentrically with respect to one another to enclose air chambers that continuously become smaller due to the aforementioned movement and which thereby move from an inlet to an outlet, whereby the pressure of the air in these air chambers increases due to the compression in the increasingly smaller air chambers.

Generally one of the two scrolls is a fixed scroll that forms part of a stator and the other scroll forms part of a rotor with a shaft driven by a motor, and on which the rotor is affixed eccentrically.

Such a type of compressor is known from EP 2.224.136, for example.

When compressing the air, heat is inevitably generated that is carried away to the environment via external cooling fins on the stator and the rotor.

Generally active cooling is applied by means of a fan that draws in air or another coolant gas and blows this coolant gas along and over the cooling fins.

For the rest of the description and the claims it will be assumed that the coolant gas is air, although the invention is not limited to an air-cooled scroll compressor.

In practice the fan and the compressor are driven by a common drive.

Conventionally a radial fan is used with a rotor that is affixed in a housing, whereby surrounding air is drawn in through an axial inlet in the axial direction of the fan, in other words is drawn in in the axial direction of the rotor, and is channelled to the other side of the drive by the housing in order to be blown out over and along the cooling fins of the scroll compressor via a deflector.

Housings of this type are formed by, on the one hand, a volute for the housing of the rotor of the fan with an axial inlet for drawing in air in the axial direction parallel to a geometric axis through the center of the inlet and perpendicular to the plane of the inlet and a radial outlet, and, on the other hand, an outlet bend fitting to this radial outlet with an axial output, whereby the volute is formed by two opposite walls, at least one of which is provided with a passage that forms the aforementioned inlet, and which are connected together by a transverse wall whose radial distance to the aforementioned axis gradually increases in a rotation direction around the axis from a starting point to an end point, and whereby on the inside of the housing the outlet bend connects to the transverse wall with an included angle at the location of the aforementioned starting point.

A disadvantage of known housings is that they involve relatively large flow losses, which results in a reduced coolant flow of the air drawn in and thus a less efficient compression and a lower general compressor performance, or even in the unusability of the compressors at higher ambient temperatures of more than 40 to 50° C., for example.

SUMMARY OF THE INVENTION

The purpose of the present invention is to provide a solution to the aforementioned and other disadvantages.

To this end the invention concerns a housing of the aforementioned type, whereby the aforementioned included angle between the outlet bend and the transverse wall at the starting point of this transverse wall is acute viewed in a perpendicular projection on a plane perpendicular to the axis of the inlet, and the included angle extends from one side of the median plane defined by the axis of the inlet and the center of the output of the outlet tube to the other side of the median plane located on the side of the end point of the transverse wall and up to a distance from this median plane.

Compared to the known housings, the aforementioned included angle between the housing and the outlet bend cuts in much more sharply and deeply.

Extensive calculations and simulations have demonstrated that as a result of this intervention the backflow of the ventilation air is greatly reduced, and in other words the air that is guided by the volute to the outlet bend does not flow back through the clearance between the rotor and the aforementioned transverse wall at the location of the aforementioned angle.

The losses that are attributable to that are thus greatly reduced and, for the same available power on the shaft of the fan rotor, there is a greater available flow rate for the cooling of the scroll compressor, such that it is better cooled, which in turn provides a better compression efficiency of the scroll compressor, as is generally known.

Preferably the outlet bend is formed such that in a cross-section according to the aforementioned median plane the outside of the outlet bend defines a circular segment with a radius that is greater than the width of the volute measured in an axial direction, and the outside wall on the outside of the outlet bend is constructed as a cylindrical wall with a center line through the center of the aforementioned circular segment and perpendicular to the aforementioned median plane.

In this way the channelling in the bend is more streamlined than in the conventional cases where rather angular bends are used.

In addition, as a result the housing is smaller compared to conventional housings with an angular outlet bend.

As a result a housing according to the invention occupies up to 18% less space, and up to a 15% material saving is also realised.

Preferably the aforementioned circular segment extends from the radial output over an angle that is such that the second wall concerned and the other end of the circular segment are each situated on an opposite side of the first wall of the volute and at a distance from it.

As a result the undesired backflow of the airflow is further reduced with the same favourable benefits as described above.

Overall, due to the adapted shape of a housing according to the invention an improvement of around 20% is realised with regard to airflow, and this notwithstanding a more compact housing and a gain with regard to the raw materials required.

According to a preferred embodiment, the housing is constructed in two parts with a dividing line between the two parts, which at the location of the volute is located in a dividing plane perpendicular to the axial direction and in a dividing plane at the location of the outlet bend that is oblique with respect to the first dividing plane.

This provides the advantage that the fan is always easy to assemble and provides easy access to the fan rotor fan for maintenance or repair.

Moreover the housing can also be made more easily in a simple mould for both halves of the housing.

The invention also relates to an air-cooled or gas-cooled scroll compressor with a radial fan with a rotor that is affixed in a housing according to the invention, whereby the drive of the rotor is inserted through the inlet of the housing and the outlet bend is provided with a deflector on its output for channelling the ventilation flow over or along the cooling fins of the scroll compressor.

BRIEF DESCRIPTION OF THE DRAWINGS

With the intention of better showing the characteristics of the invention, a preferred embodiment of a housing according to the invention for channelling the airflow of a fan of an air-cooled or gas-cooled scroll compressor and of a scroll compressor with a fan with such a housing is described hereinafter by way of an example, without any limiting nature, with reference to the accompanying drawings, wherein.

DETAILED DESCRIPTION OF THE INVENTION

Figure 1:
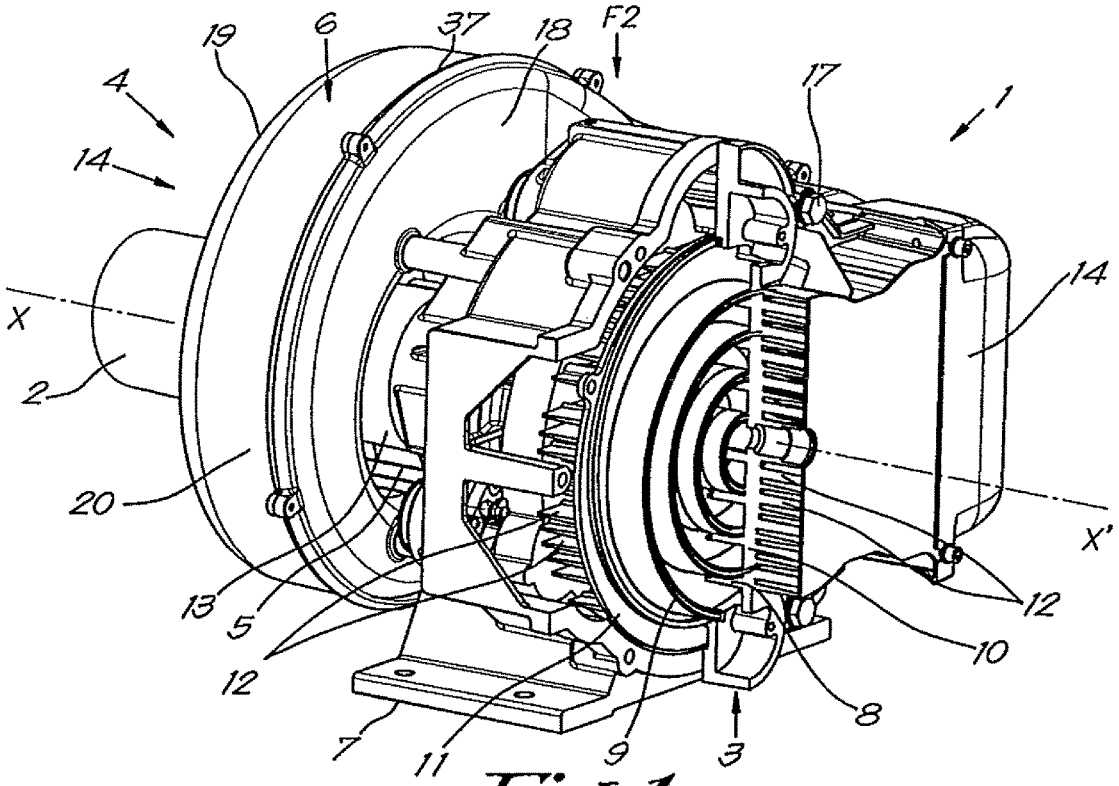
FIG. 1 schematically shows a perspective view of an air-cooled or gas-cooled scroll compressor with a fan with a housing according to the invention, and with the partial omission of certain parts.

The compressor 1 shown in FIG. 1 is composed of a drive 2, for example in the form of a motor or belt transmission with a shaft with a geometric axis X-X', for the drive of a scroll compressor 3 and a radial fan 4 that is provided with a rotor 5 that is rotatably affixed in a housing 6.

It is all constructed on a supporting structure 7.

As is known the scroll compressor 3 comprises two scrolls 8 that can interact with one another and of which one scroll 8 is affixed on a stator plate 10 that is fastened to the chassis, while the other scroll 9 forms part of a rotor plate 11 that can be driven by the drive 2 in a known way in an orbital motion around the axis X-X'.

Both the stator plate 10 and the rotor plate 11 are provided with cooling fins 12 to be able to carry the heat generated by the compression work of the scroll compressor 3 to the environment.

Figure 2:
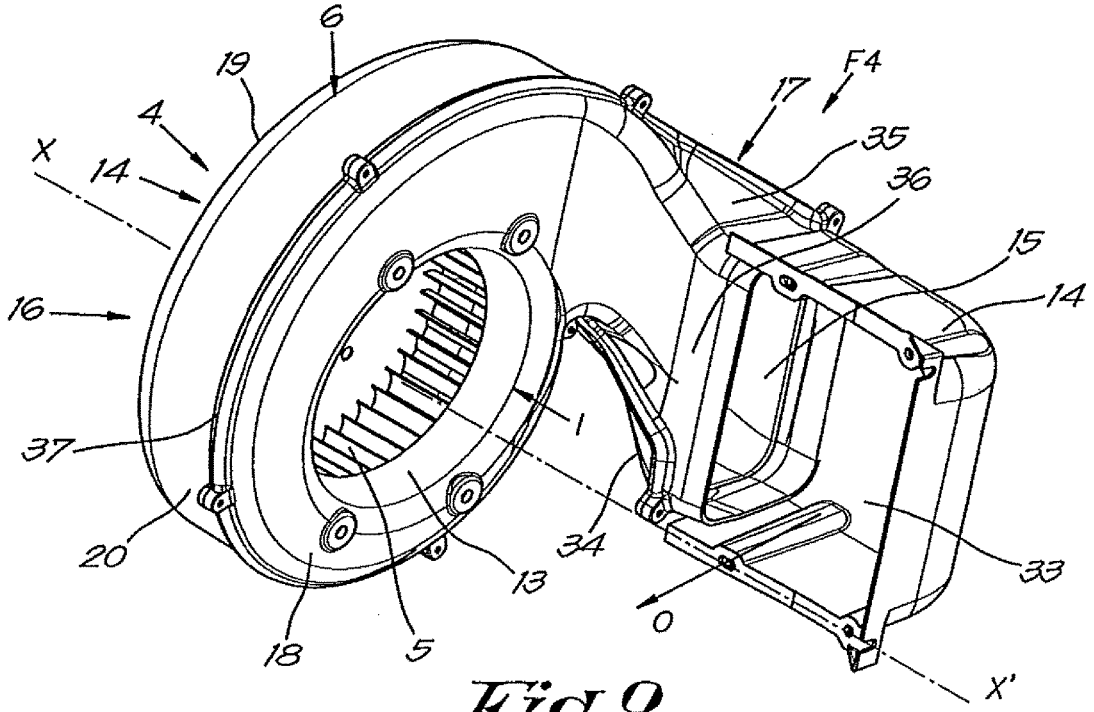
FIG. 2 shows the housing of the fan indicated in FIG. 1 by F2, supplemented by a deflector and a rotor.
Figure 3:
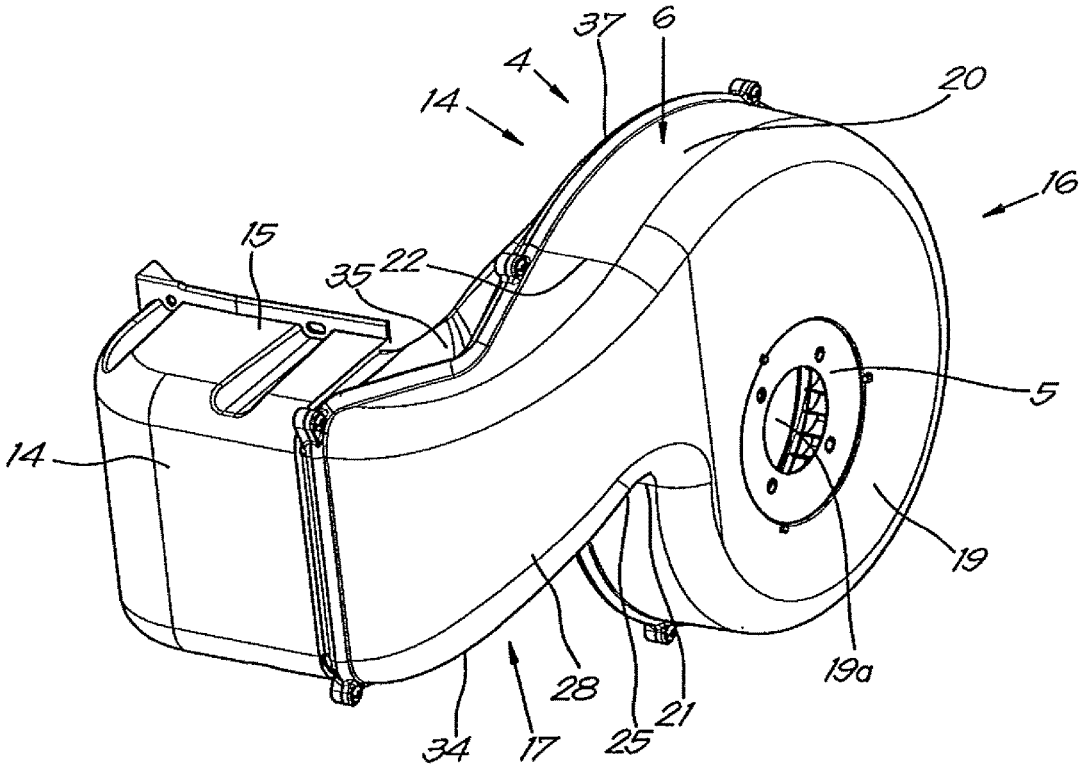
FIGS. 3 and 4 each show a different perspective view of the housing of FIG. 2, but without the deflector and without the rotor in the case of FIG. 4.
Figure 4:
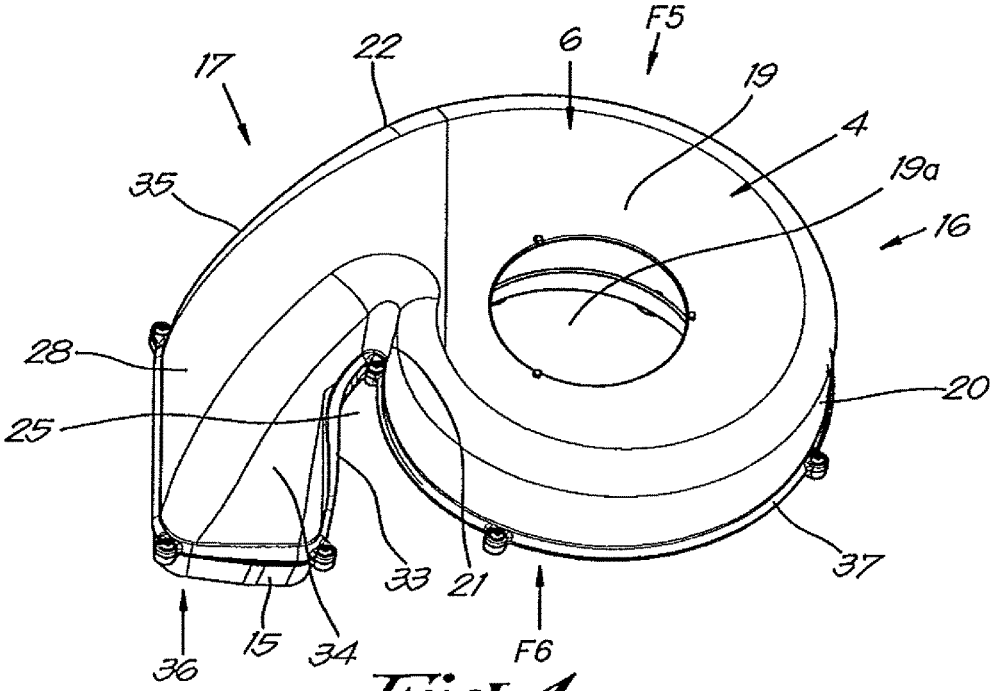

For an efficient removal of the compression heat, surrounding air is drawn in axially via an inlet 13 of the fan 4 in a direction parallel to the axis X-X', as shown by arrow I in FIG. 2, and is blown in a direction transverse to the axis X-X', as indicated by arrow O in FIG. 2, over and along the cooling fins 12 of the scroll compressor 3 via a deflector 14 at the output 15 of the housing 6.

The housing 6 of the fan is formed by a volute 16 in which the rotor 5 of the fan 4 is affixed, and an outlet bend 17 fitted perpendicularly to this volute 16.

The volute 16 is formed by two opposite, essentially parallel, walls 18 and 19, respectively a first wall 18 on the side of the scroll compressor 3 that is provided with a passage for the shaft of the drive 2 and which also acts as an aforementioned axial inlet 13, and a second wall 19 on the opposite side that is also provided with a passage 19*a* for the shaft of the drive.

These walls 18 and 19 are connected together by a continuous transverse wall 20 whose radial distance r to the aforementioned axis X-X' in the rotation direction of the rotor 5 around the axis X-X' gradually increases from a starting point 21, where the radial distance r is the smallest, to an end point 22 where the radial distance r is the largest.

Figure 9:
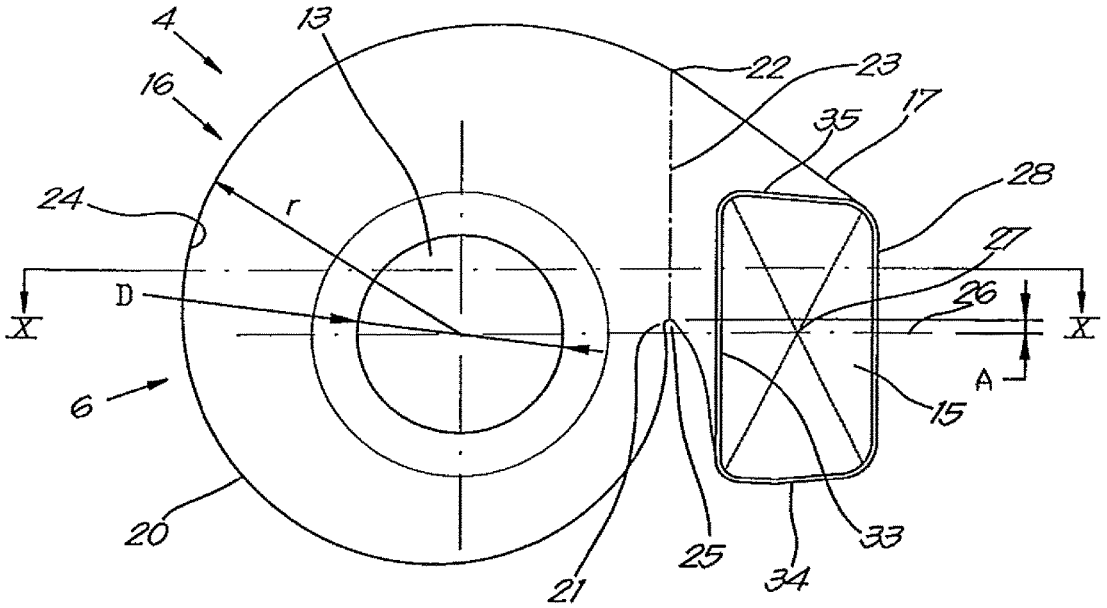
FIG. 9 shows a simplified presentation of the housing.

An opening is left between the aforementioned starting point 21 and end point 22, which together with the first wall 18 and the second wall 19 define a radial outlet 23 for the air that is moved by the rotor 5 and to which the transverse outlet bend 17 fits in order to bend the outcoming radial airflow towards an axial direction opposite the flow direction I of the air drawn into the inlet 13, as shown in FIG. 9.

Figure 5:
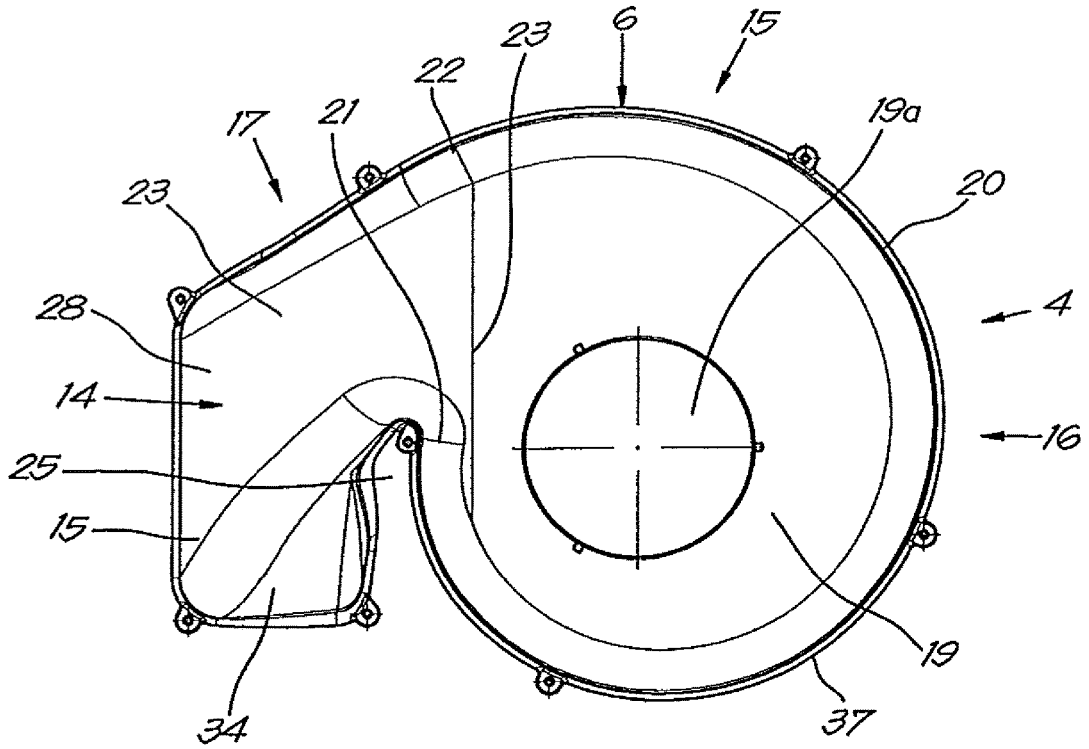
FIGS. 5 and 6 show a view according to arrows F5 and F6 respectively in FIG. 4.
Figure 6:
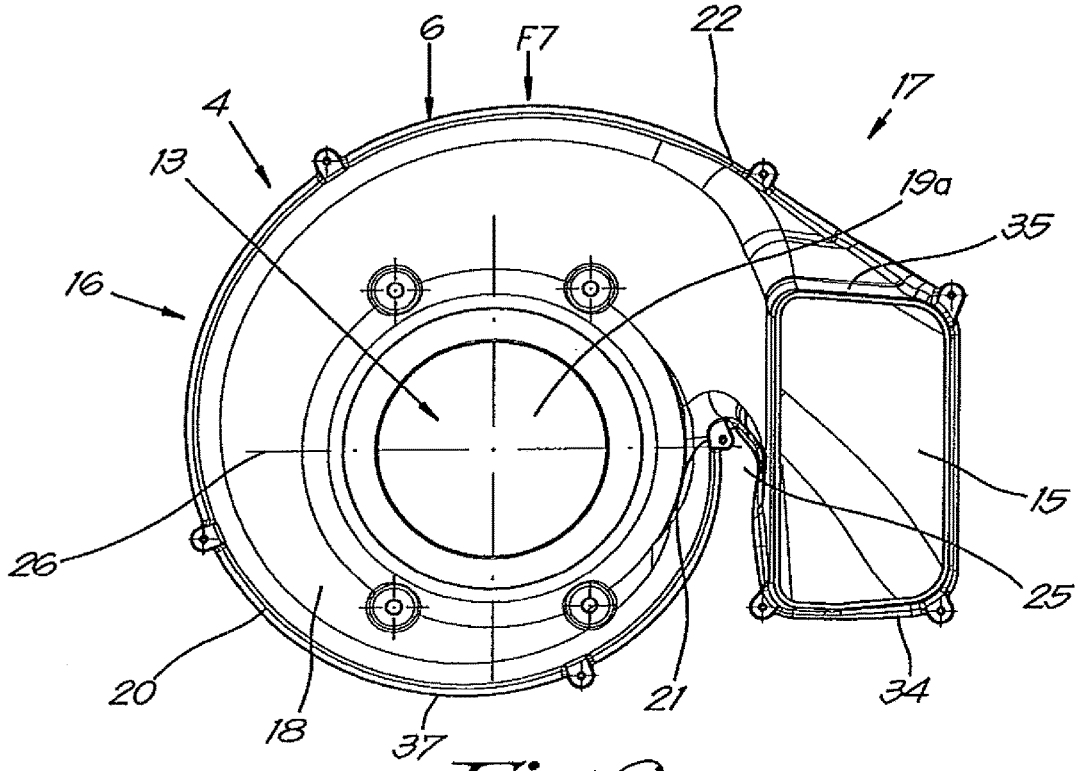
Figure 7:
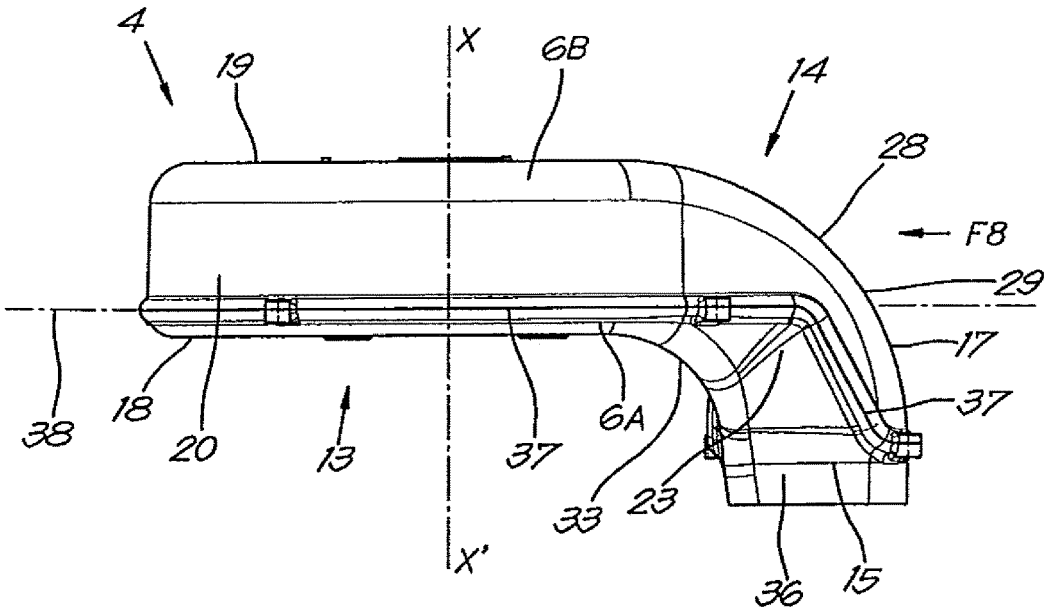
FIG. 7 shows a view according to arrow F7 in FIG. 6.
Figure 8:
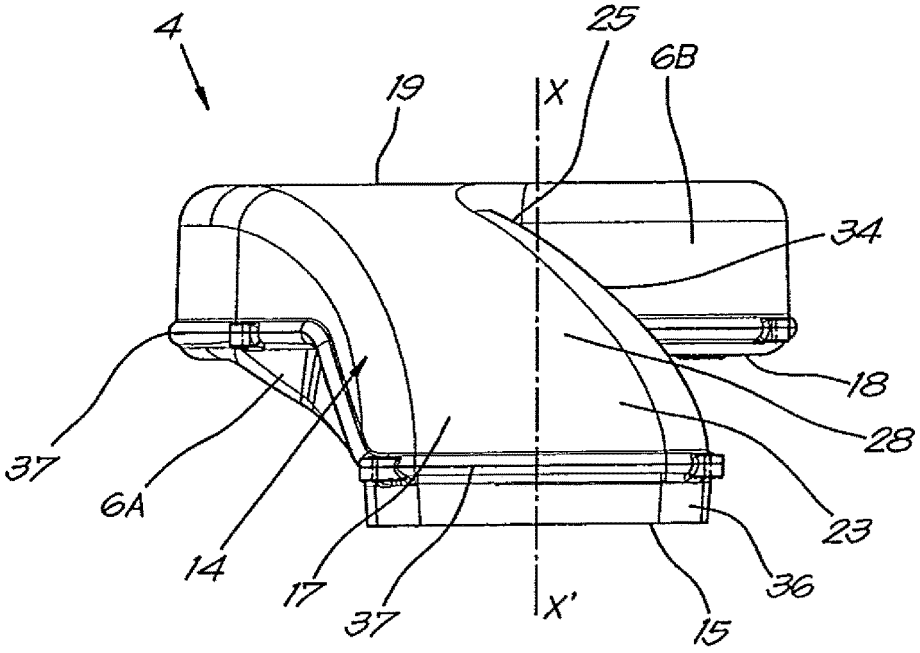
FIG. 8 shows a view according to arrow F8 in FIG. 7.

At the location of the end point 22 the outlet bend 17 fits tangentially to the transverse wall 20, at least viewed in a perpendicular projection on a plane perpendicular to the axis X-X' such as in FIGS. 5 and 9, while at the location of the starting point 21 the outlet bend 17 on the inside 25 of the housing 6 fits to the transverse wall 20 with an included angle 25, which according to a preferred characteristic of the invention is an acute angle 25, as can be seen in FIG. 9, and which extends from one side of the median plane 26 defined by the axis X-X' and the center 27 of the output 15 of the outlet bend 17 to the other side of the median plane 26 located on the side of the end point 22 of the transverse wall 20 and up to a distance A from this median plane 26, as shown in FIG. 9.

Thus a relatively deep and sharp incision is obtained in the housing 6, whereby the aforementioned distance A from the starting point 21 of the transverse wall 20 to the median plane 26 is preferably greater than five percent of the diameter D of the inlet 13, and more preferably greater than ten percent of this diameter D.

Figure 10:
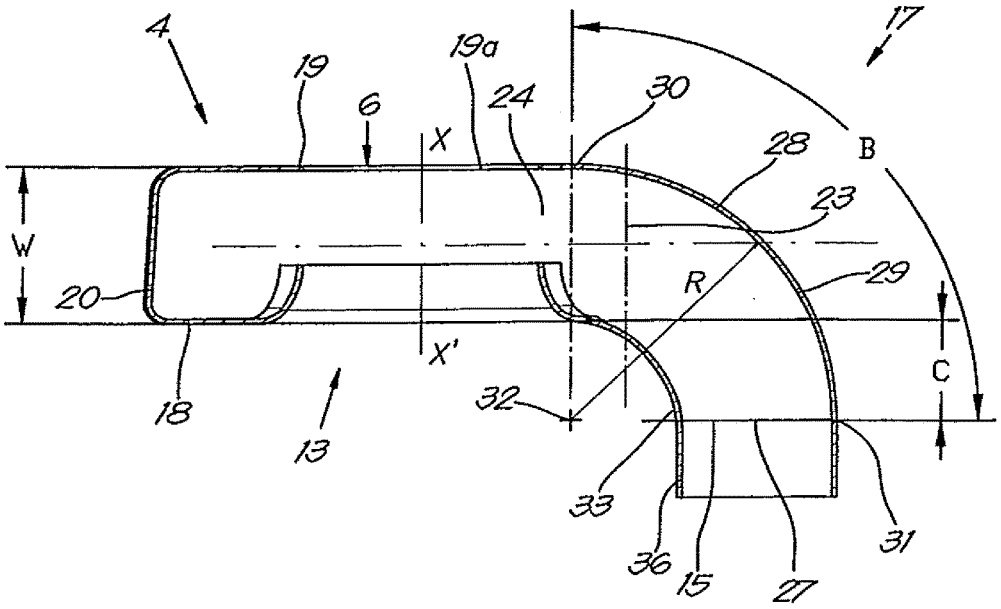
FIG. 10 shows a cross-section according to line X-X in FIG. 9.

According to another preferred characteristic of the invention the form of the outlet bend 17 is such that, viewed in a cross-section according to the aforementioned median plane 26, as shown in FIG. 10, the outside wall 28 on the outside of the outlet bend 17 defines a circular segment 29 with a radius R that is greater than the width W of the volute 16 measured in the direction of the axis X-X', and which fits tangentially at one end 30 to the second wall 19 of the volute 16.

The aforementioned circular segment 29 defines an angle B of 90° for example, that is preferably sufficiently large to ensure that the other end 31 of the circular segment 29 and the second wall 19 are each situated at an opposite side of the first wall 18 of the volute 16 and at a distance C from it.

The outside wall 28 of the outlet bend 17 is preferably a cylindrical outside wall 28 with a center line through the center 32 of the aforementioned circular segment 29 and perpendicular to the aforementioned median plane 26.

Analogously the inside wall 33 of the outlet bend 17 is preferably a cylindrical inside wall 33 which, in this case but not necessarily, is concentric to the cylindrical outside wall 28 and which fits tangentially to the first wall 18 with the inlet 13.

The inside wall 33 and outside wall 28 are connected together by two connecting walls 34 and 35, which together with the inside wall 33 and the outside wall 28 define a channel.

The outlet bend 17 is provided with a straight extension piece 36 in the axial extension of the output 15.

The aforementioned deflector 14 connects to this extension piece 36, fitting to the comic section of the outlet bend 17, in order to bend the axial flow coming from the outlet bend 17 transversely in the direction of the cooling fins 12 of the scroll compressor.

This deflector 14 can be constructed as a separate part that is mounted on the outlet bend 17 as in the case of the drawings, but can also be integrated as part of the housing 6 itself.

The use of the compressor 1 is completely analogous to the use of a conventional compressor, with the difference that due to the specific design of the housing 6 of the fan 4, the flow losses are substantially lower and the compressor 1 can be used in applications where less space is available due to the small volume of the housing 6, as can be illustrated by comparing the housing 6 according to the invention to a conventional housing as shown in FIGS. 13 to 16.

The housing 6 without deflector 14 is preferably constructed in two parts with a dividing line 37 between the two parts 6A and 6B.

Figure 11:
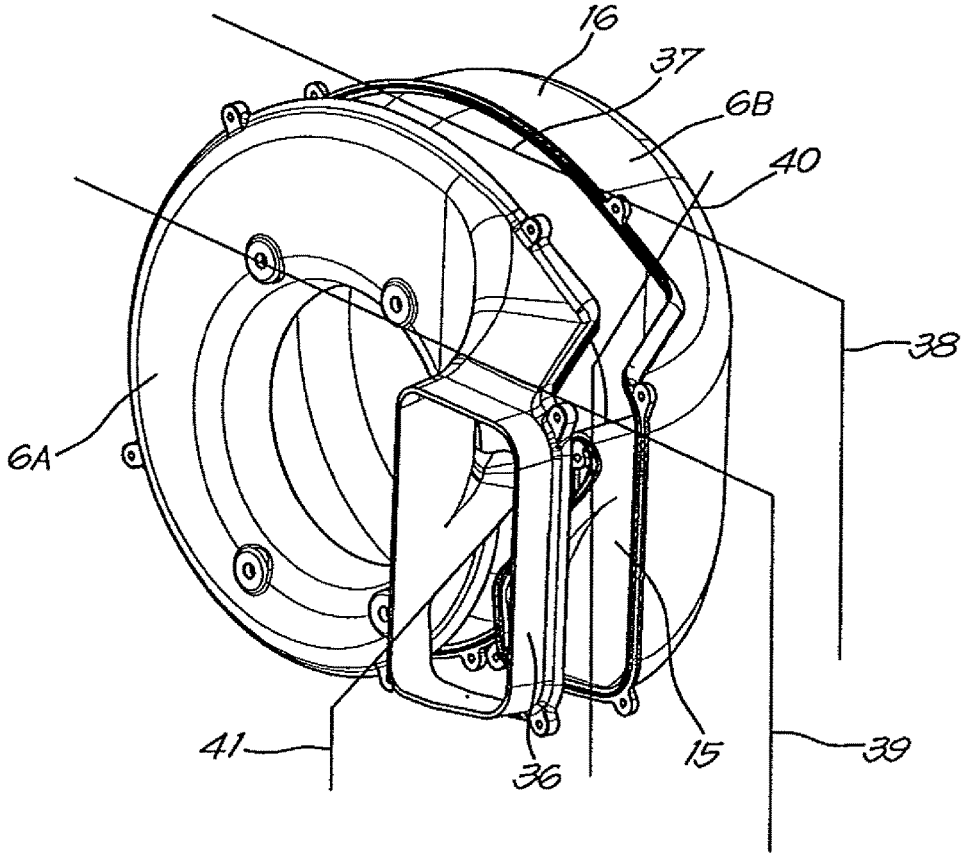
FIG. 11 shows an exploded perspective view of the housing of FIG. 4, viewed from a different angle.
Figure 12:
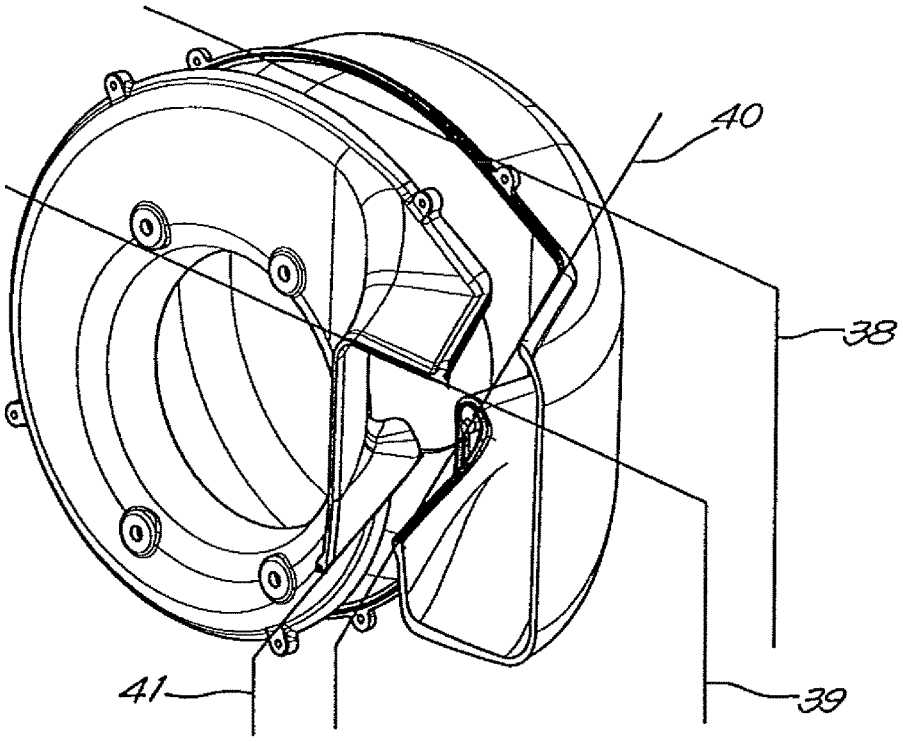
FIG. 12 shows an exploded perspective view as in FIG. 11, but for a variant embodiment.
Figure 13:
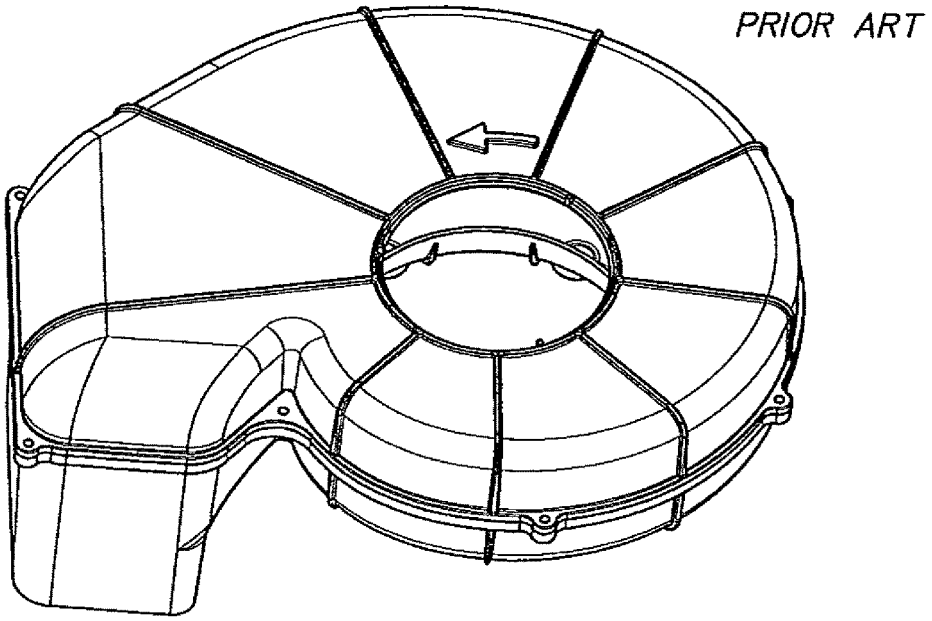
FIGS. 13 to 16 show views of a conventional housing, for comparison to the corresponding views of FIGS. 4, 6, 7 and 8 of a housing according to the invention.
Figure 14:
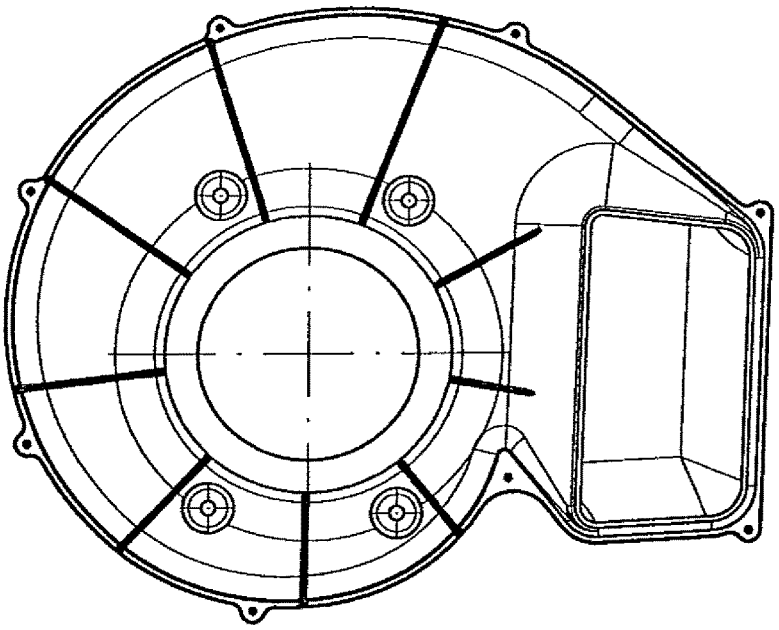
Fig. 14 PRIOR ART
Figure 15:
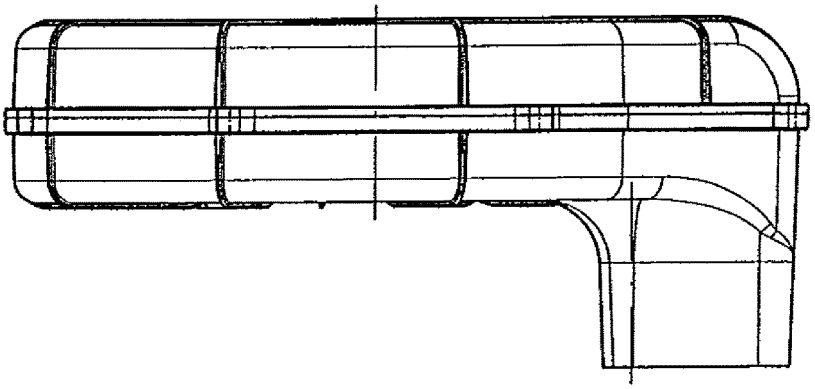
Figure 16:
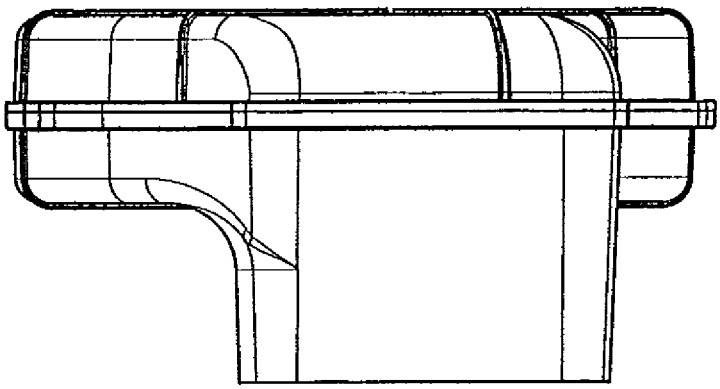

FIG. 11 presents both parts 6A and 6B separate from one another.

At the location of the volute 16 and the output 15, the dividing line 37 is formed by a dividing plane, 38 and 39 respectively, as shown in FIG. 11, and these dividing planes 38 and 39 are perpendicular to the axis X-X'.

At the location of the connecting wall 35 and the inside wall 33 of the outlet bend 17, the dividing line 37 is located in a dividing plane 40 and in a dividing plane 41 respectively that are oblique with respect to the dividing planes 38 and 39.

In this way the fan 4 can be easily assembled and dismantled, for example for maintenance, repair or replacement of the rotor 5.

Moreover, these parts 6A and 6B can be realised in a relatively easily constructed mould or die without moving parts.

The edges at the location of the dividing line 37 between the constituent parts 6A and 6B of the housing 6 are preferably constructed with a tongue and groove profile that provides a seal between the two parts 6A and 6B.

The housing 6 can of course be divided into constituent parts in other ways.

In the case of FIG. 11, the dividing plane 39 is situated at the location of the output 15 and the extension piece is completely cut off from the outlet bend 17.

Although in FIGS. 1 to 10 the second wall 19 of the volute 16 is constructed with a passage 19*a* for the shaft of the drive 2, it is not excluded that this wall 19 is a closed wall and that the inlet 13 in the first wall can act as the only passage for the drive 2 when this drive 2 is between the fan and the scroll compressor.

In this case, if need be the opening 19*a* can continue to be there as an access opening for the maintenance of the fan, whereby this opening 19*a* can be closed with a cover, for example.

The present invention is by no means limited to the embodiment described as an example and shown in the drawings, but a housing according to the invention for channelling the airflow of a fan of an air-cooled or gas-cooled scroll compressor and of a scroll compressor with a fan with such a housing can be realised in all kinds of forms and dimensions, without departing from the scope of

The invention claimed is:

1. A housing for channelling an airflow of a radial fan of an air-cooled scroll compressor, comprising:

a volute for the housing of a rotor of the radial fan with an axial inlet for drawing in air in an axial direction parallel to a geometric axis through a center of the axial inlet and perpendicular to a plane of the axial inlet and a radial outlet, and an outlet bend fitting to the radial outlet with an axial output, whereby the volute is formed by two opposite walls, at least one of which is provided with a passage that forms the axial inlet, and which are connected together by a transverse wall whose radial distance to the geometric axis gradually increases in a rotation direction around the geometric axis from a starting point to an end point, and whereby on an inside of the housing, the outlet bend connects to the transverse wall with an included angle at the location of the starting point, wherein the included angle is an acute angle viewed in a perpendicular projection on a plane perpendicular to the axis of the axial inlet, and the included angle extends from one side of the median plane defined by the axis of the axial inlet and a center of the axial output of the outlet bend to the other side of the median plane located on the side of the end point of the transverse wall and at a distance from this median plane.

2. The housing according to claim 1, wherein a shortest distance from the starting point of the transverse wall to the median plane is greater than five percent of the diameter of the axial inlet.

3. The housing according to claim 2, wherein the outlet bend at the location of the aforementioned end point of the transverse wall fits essentially tangentially to this transverse wall, viewed in a perpendicular projection on a plane perpendicular to the axis of the axial inlet.

4. The housing according to claim 2, wherein the shortest distance from the starting point of the transverse wall to the median plane is greater than ten percent of the diameter of the axial inlet.

5. The housing according to claim 1, wherein the outlet bend at the location of the end point of the transverse wall fits essentially tangentially to this transverse wall, viewed in a perpendicular projection on a plane perpendicular to the axis of the axial inlet.

6. The housing according to claim 1, wherein the outlet bend forms a channel for bending the flow originating from the radial outlet in an axial direction opposite to the flow direction in the axial inlet.

7. The housing according to claim 1, wherein in a cross-section according to the median plane, the outside wall of the outlet bend defines a circular segment with a radius that is greater than the width of the volute measured in the axial direction.

8. The housing according to claim 7, wherein an end of the circular segment of the outside wall of the outlet bend fits tangentially to the second wall of the volute.

9. The housing according to claim 8 wherein the aforementioned circular segment extends from the radial output over an angle that is such that the second wall concerned and the other end of the circular segment are each located at an opposite side of the first wall of the volute and at a distance therefrom.

10. The housing according to claim 7 wherein the circular segment extends from the radial output over an angle that is such that the second wall concerned and the other end of the circular segment are each located at an opposite side of the first wall of the volute and at a distance therefrom.

11. The housing according to claim 10, wherein the aforementioned circular segment extends from the radial output over an angle of 90°.

12. The housing according to claim 7, wherein the outside wall is a cylindrical wall with a center line through the center of the circular segment and perpendicular to the median plane.

13. The housing according to claim 12, wherein the inside wall on the inside of the outlet bend is a cylindrical wall that is concentric to the cylindrical outside wall.

14. The housing according to claim 7, wherein in a cross-section according to the median plane, the inside wall of the outlet bend defines a circular segment.

15. The housing according to claim 14, wherein the circular segment of the outlet bend on the inside wall is concentric to the circular segment of the outside wall of the outlet bend.

16. The housing according to claim 15, wherein the circular segment of the inside wall of the outlet bend fits tangentially to the first wall.

17. The housing according to claim 14, wherein the circular segment of the inside wall of the outlet bend fits tangentially to the first wall.

18. The housing according to claim 1, wherein the housing is constructed from two parts with a dividing line between the two parts which, at the location of the transverse wall of the volute is located in a dividing plane perpendicular to the geometric axis, and at the location of the outlet bend in two dividing planes that are oblique with respect to the first dividing plane.

19. An air-cooled scroll compressor with a radial fan with a rotor that is affixed in a housing, wherein the housing is a housing according to claim 1.

20. The air-cooled scroll compressor according to claim 19, wherein the axial output of the outlet bend is provided with a deflector for channelling the ventilation flow over or along the cooling fins of the scroll compressor.

21. A housing for channelling an airflow of a radial fan of an air-cooled scroll compressor, comprising:

a volute for the housing of a rotor of the radial fan with an axial inlet for drawing in air in an axial direction parallel to a geometric axis through a center of the axial inlet and perpendicular to a plane of the axial inlet and a radial outlet, and an outlet bend fitting to the radial outlet with an axial output, whereby the volute is formed by two opposite walls, at least one of which is provided with a passage that forms the axial inlet, and which are connected together by a transverse wall whose radial distance to the geometric axis gradually increases in a rotation direction around geometric axis from a starting point to an end point, and whereby on an inside of the housing, the outlet bend connects to the transverse wall with an included angle at the location of the starting point, wherein the included angle is an acute angle viewed in a perpendicular projection on a plane perpendicular to the axis of the axial inlet, and the included angle extends from one side of the median planer defined by the axis of the axial inlet and the center of the axial output of the outlet bend to the other side of the median plane located on the side of the end point of the transverse wall and at a distance from this median plane, wherein a shortest distance from the starting point of the transverse wall to the median plane is greater than five percent of the diameter of the axial inlet, and wherein the outlet bend forms a channel for bending the airflow originating from the radial outlet in an axial direction opposite to the flow direction in the axial inlet.

* * * * *